US006049345A

United States Patent [19]

Nishio et al.

[11] Patent Number: 6,049,345

[45] Date of Patent: Apr. 11, 2000

[54] IMAGE FORMING APPARATUS SELECTIVELY CHARGING TONER USING DOCTOR BLADE

[75] Inventors: Yukihito Nishio, Yamatokouriyama; Shiro Narikawa, Kashihara; Hirokazu Fujita, Nara; Yoshinobu Okumura, Yamatokouriyama; Hideo Yamasa, Yamatokouriyama; Takeshi Iriuchijima, Yamatokouriyama, all of Japan

[73] Assignee: Sharp Kabushiki Kaisha, Osaka, Japan

[21] Appl. No.: 08/572,412

[22] Filed: Dec. 14, 1995

[30] Foreign Application Priority Data

Dec. 14, 1994 [JP] Japan ..... 6-310478

[51] Int. Cl.[7] ..... B41J 2/39; B41J 2/395; B41J 2/40; G03G 15/00

[52] U.S. Cl. ..... 347/151; 399/284

[58] Field of Search ..... 347/151, 158, 347/55; 430/45, 31, 46, 126, 901; 399/350, 71, 123, 284

[56] References Cited

U.S. PATENT DOCUMENTS

| | | | |
|---|---|---|---|
| 4,502,061 | 2/1985 | Ando et al. | 347/158 |
| 4,521,502 | 6/1985 | Sakai et al. . | |
| 4,544,935 | 10/1985 | Sakai | 347/151 |
| 4,797,695 | 1/1989 | Konno et al. | 347/140 |
| 4,921,768 | 5/1990 | Kunugi et al. | 430/31 |
| 5,153,616 | 10/1992 | Asanae et al. | 347/151 |
| 5,416,569 | 5/1995 | Goldberg . | |

FOREIGN PATENT DOCUMENTS 60-149057 8/1985 Japan .

*Primary Examiner*—Arthur T. Grimley
*Assistant Examiner*—Raquel Yvette Gordon
*Attorney, Agent, or Firm*—Dike, Bronstein, Roberts & Cushman, LLP; David G. Conlin; William J. Daley, Jr.

[57] ABSTRACT

A doctor blade is provided in contact with frictionally charged toner in a toner tank, which regulates the amount of toner held on a toner holder. A charge control unit supplies to the doctor blade a voltage for selectively charging the toner. As a result, the amount of toner held on the toner holder is regulated, and simultaneously, the toner is charged to a specific polarity with a potential of the frictional charge or more. An electrostatic latent image is formed by the selectively charged toner. The toner is moved and transferred onto a papersheet which is sequentially transported, under the influence of an electric field generated by application of a voltage to an opposite electrode disposed opposing the toner holder. An image by the toner is thus formed on the papersheet.

5 Claims, 5 Drawing Sheets

IMAGE FORMING APPARATUS SELECTIVELY CHARGING TONER USING DOCTOR BLADE

BACKGROUND OF THE INVENTION

1. Field of the Invention

The present invention relates to image forming apparatuses, and more particularly, to an image forming apparatus forming an image by transferring selectively charged toner to a recording member such as a sheet-like member.

2. Description of the Related Art

In a conventional image forming apparatus forming an electric image signal as a visual image, image data was optically drawn on a recording medium including a photosensitive layer having electro-optic characteristics such as the surface of a photoreceptor using particulate toner serving as a coloring agent to form an electrostatic latent image (electrostatic pattern). The toner was attached to the electrostatic latent image to form the visual image. The visualized toner image was transferred to a sheet-like member such as a papersheet to form a desired image.

As the above described image forming apparatus employing electrophotography, a laser printer, an LED printer, and the like are well known.

In order to form an image on a photoreceptor, such a printer employing electrophotography requires a plurality of units constituting an image forming system around the photoreceptor. The printer requires a charger, an optical system (for example, laser irradiating means), a developing device, a transferring device, a cleaning device, a discharger, and the like. Therefore, the printer is under a restriction on reduction in size.

On the other hand, in order to form an image using toner without employing the above described electrophotography, toner held on a toner holder is selectively charged, and the selectively charged toner is transferred to a papersheet which is sequentially fed to form a desired image. An apparatus for forming an image in this manner is disclosed in Japanese Patent Laying-Open No. 60-149057, for example.

Referring to FIG. 10, the principle of image formation disclosed in this publication will be described. The image forming apparatus in FIG. 10 includes a toner hopper 101 housing one-component toner, a toner holder 102 holding the toner, a doctor blade 103 regulating the amount of toner held on the surface of toner holder 102, an electric charge injecting element 104 selectively charging the toner held by toner holder 102, for example, selectively injecting electric change to the toner held by toner holder 102, a transfer roller 106 for transferring the selectively charged toner to a recording sheet 105, and a control slit 107 disposed between transfer roller 106 and toner holder 102 for controlling transfer of the selectively charged toner.

Image forming operation based on the principle will be described. The toner in toner hopper 101 is held by toner holder 102. The amount of toner is regulated by doctor blade 103 to form a toner layer having a predetermined thickness on toner holder 102. By being supplied with a voltage having a specific polarity, doctor blade 103 is charged to the polarity. The toner held by toner holder 102 is selectively charged by electric charge having the opposite polarity through electric charge injecting element 104 according to a desired image. As a result, an electric latent image (for example, electrostatic latent image) is formed on the toner layer held on the surface of toner holder 102. When the toner forming the latent image reaches the position of transfer roller 106, the toner is influenced by the voltage applied to transfer roller 106 to be attracted electrostatically and to be transferred to sheet 105. When the toner passes through control slit 107, control slit 107 prevents repulsion among pieces of the toner to transfer the toner onto sheet 105 by narrowing down the transfer width of the toner. Since the toner transferred onto sheet 105 as described above has not been fixed on sheet 105, the toner is fixed in the following step, enabling formation of a desired image on the sheet.

The image forming apparatus disclosed in Japanese Patent Laying-Open No. 60-149047 does not require a photoreceptor, unlike the image forming apparatus employing electrophotography. This image forming apparatus of Japanese Patent Laying-Open No. 60-149047 selectively charges toner held by the toner holder, and transfers the selectively charged toner to a sheet. Therefore, a charger, an image exposing area, a discharger, and a cleaning device are not required, resulting in reduction in size and cost.

However, the above described image forming apparatus regulates by the doctor blade the thickness of the toner layer held by the toner holder, and selectively charges the toner layer formed by the electric charge injecting element, resulting in increase in the number of components.

Further, in order to inject electric charge in the toner using the electric charge injecting element, the conductive toner must be used in the above described image forming apparatus. More specifically, if the toner is not conductive, electric charge is not injected. Since the conductive toner must contain a substance other than a coloring agent in order to increase the conductivity, it becomes difficult to prepare color toner. Therefore, it is difficult to obtain three-color toner for full color image formation.

If insulative toner is used, three-color toner for full color image formation can be obtained. However, if the insulative toner is used in the image forming apparatus injecting electric charge to the toner as described above, desired electric charge cannot be injected in the toner. Further, when the selectively charged conductive toner is transferred onto a sheet, the conductive toner is less likely to be transferred to the sheet if the sheet is conductive. Therefore, an insulated sheet having high resistance is required, and the image forming apparatus is further under a restriction on the sheet.

Further, when the toner held on the toner holder and later selectively charged is transferred onto the sheet, a transfer roller is used. A toner transfer area is determined by the curvature of the transfer roller. If the transfer area is large, the toner starts to be transferred gradually before the sheet completely reaches the transfer area, causing degradation of resolution.

SUMMARY OF THE INVENTION

One object of the present invention is to provide an image forming apparatus which can be reduced in size and cost.

Another object of the present invention is to provide an image forming apparatus which can selectively charge not only conductive toner but also insulative toner.

Still another object of the present invention is to provide an image forming apparatus which can obtain a stable image independent of environmental change.

The above objects of the present invention are achieved by an image forming apparatus including the following elements. According to one aspect of the present invention, an image forming apparatus holding toner on a toner holder and forming an image according to externally applied image data of the present invention includes a toner tank storing the toner, a toner holder holding the toner supplied from the toner tank, a doctor blade for regulating the amount of toner held on the toner holder and for selectively charging the toner according to the externally applied image data, and an opposite electrode for transferring the selectively charged toner onto a sheet.

Since the doctor blade regulating the amount of toner held on the toner holder selectively charges the toner according to the image data, it is not necessary to provide an electric charge injecting element, which is typically required by a conventional image forming apparatus. As a result, an image forming apparatus which can be reduced in size and cost can be provided.

Preferably, the doctor blade is connected to a voltage supplier for supplying a voltage for selectively charging the toner to a specific polarity according to the image data.

Preferably, the doctor blade is divided into conductive electrodes corresponding to pixels constituting the image data and insulated from each other, and the voltage supplier selectively supplies a voltage to the divided conductive electrodes according to the image data.

When the voltage is applied to the divided conductive electrodes each of a size corresponding to one pixel in the doctor blade, the amount of charge of the toner is larger in a portion supplied with the voltage than in a portion not supplied with the voltage. Therefore, by selectively supplying the voltage to each conductive electrode according to the image, a constant amount of toner held on the toner holder is selectively charged, and an electrostatic latent image by the toner is formed.

As a result of an experiment, it was found that a larger voltage applied to the doctor blade in particular increased the amount of charge of a toner particle. More specifically, the amount of charge of the toner is influenced by the intensity of an electric field which acts through the toner between the doctor blade and the toner holder. The larger the intensity of the electric field, the larger the amount of charge of the toner. On the contrary, the lower the voltage applied to the doctor blade, the lower the amount of charge of the toner. Therefore, by controlling a voltage value to be supplied to the doctor blade according to the density of an image to be formed, a half tone image can be formed.

According to another aspect of the present invention, an image forming apparatus holding toner on a toner holder uniformly, selectively charging the held toner according to image data, and then transferring the selectively charged toner onto a sheet to form an image includes a toner tank storing the toner, a cylindrical toner holder holding the toner and rotating, and a doctor blade for regulating the amount of toner held on the toner holder and supplying a voltage for charging the toner to a specific polarity. The toner holder includes a transparent conductive layer formed on the surface of a transparent cylinder and a photoconductive layer formed on the transparent conductive layer.

By supplying to the doctor blade a voltage for charging the toner on the toner holder to a specific polarity and directing light representing the image from inside the transparent cylinder of the toner holder, the toner held on the toner holder is selectively charged.

Since the toner holder has the transparent conductive layer provided on the transparent cylinder and the photoconductive layer provided on the transparent conductive layer, light representing the image is directed from inside the transparent cylinder. Since a resistance value of the photoconductive layer of an area irradiated with the light decreases at this time, the intensity of an electric field which acts between the toner holder and the doctor blade increases. The amount of charge of the toner in the area irradiated with the light increases, resulting in formation of an electrostatic latent image using the toner.

By using a photoconductive member in order to selectively charge the toner, a member regulating the toner can be structured simply. By disposing the photoconductive member on the side of the toner holder, the area irradiated with light can be disposed inside the toner holder. As a result, the apparatus can be more reduced in size.

Preferably, the image forming apparatus includes a sensor detecting environmental change around the image forming apparatus, and a controller for controlling a voltage supplied between the doctor blade and the toner holder or a voltage for transferring the selectively charged toner onto the sheet in response to a detect signal of the sensor.

Since control of the amount of charge of the toner or control for movement of the toner is carried out according to the environmental change if necessary, a stable image can be obtained independent of the environmental change.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 2:
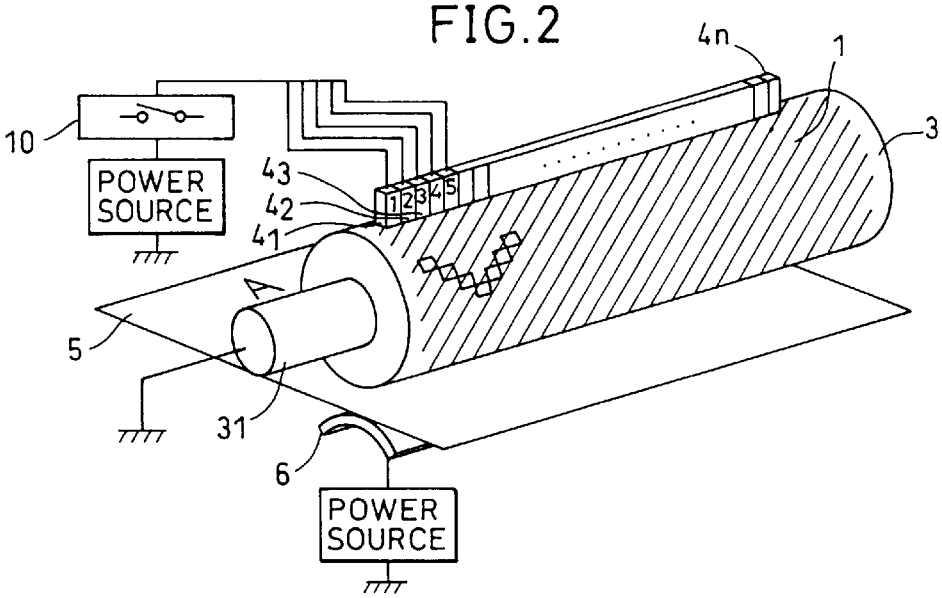
FIG. 2 is a perspective view showing the main part of an image forming system showing one embodiment of the image forming apparatus according to the present invention.
Figure 3:
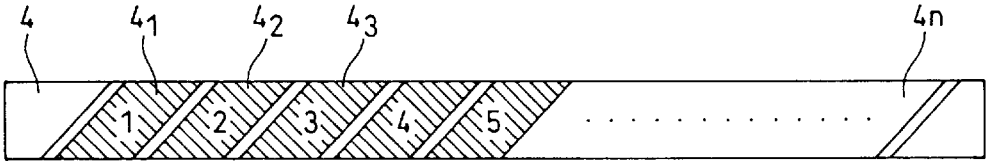
FIG. 3 is a rear elevation showing one example of formation of electrodes in a doctor blade regulating toner, which constitutes the image forming apparatus according to the present invention.

One embodiment of the present invention will be described with reference to FIGS. 1 to 3.

Figure 1:
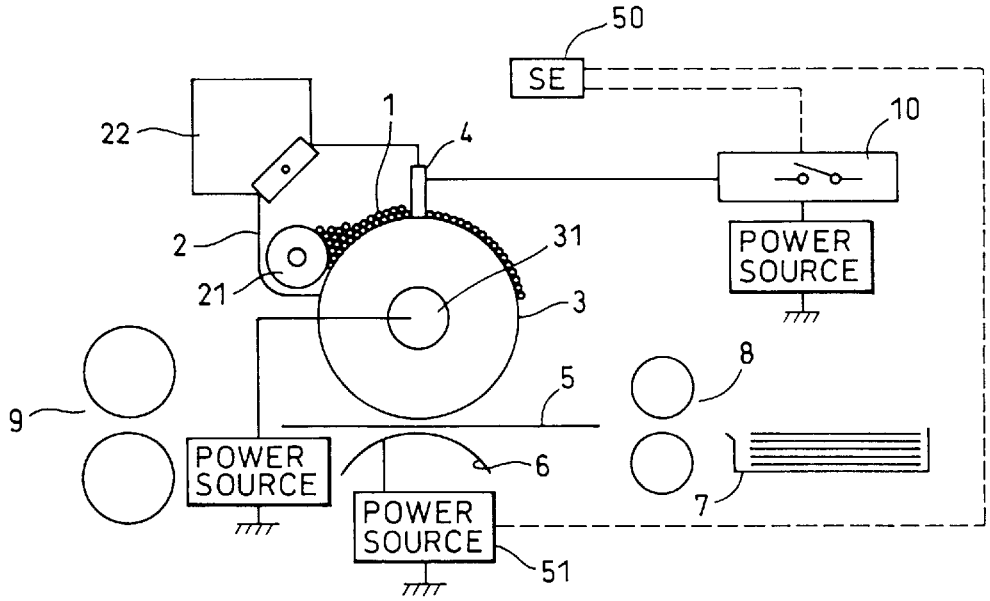
FIG. 1 is a schematic sectional view of an image forming apparatus for describing the principle of image formation according to the present invention.

Before describing the principle of image formation by the image forming apparatus according to the present invention, the overall structure of the image forming apparatus will be described hereinafter, as shown in FIG. 1.

The image forming apparatus includes a toner tank 2 housing toner 1, a toner holder 3 including a part of toner tank 2, in contact with toner 1, and holding necessary toner, a doctor blade 4 provided on the side of toner tank 2 for regulating the amount of toner to be held on toner holder 3 and selectively charging the toner held on toner holder 3, and an opposite electrode 6 for moving and transferring the selectively charged toner from toner holder 3 to a papersheet 5 for recording which is sequentially transported.

Papersheet 5 is housed in a paper feed cassette 7 detachably provided to the body of the image forming apparatus, for example. The transport system of papersheet 5 includes a sheet feeder (not shown) disposed opposite to paper feed cassette 7 mounted to the body of the image forming apparatus for feeding papersheet 5 one by one. The transport system transports the papersheet to a transfer area between opposite electrode 6 and toner holder 3 through a register roller 8 so that the leading edge of the papersheet matches the front edge of a latent image formed on toner holder 3 by the selectively charged toner.

Since papersheet 5 passing through the transfer area has unfixed toner held on its upper surface, papersheet 5 is discharged from the body of the image forming apparatus through a heating and fixing device 9 disposed in the transport system. Heating and fixing device 9 is formed of a pair of rollers, for example. With the upper roller in contact with the toner as a heating roller, heating and fixing device 9 further includes a pressure roller which is pressurized by an appropriate pressure with respect to the heating roller. Heating and fixing device 9 fixes the toner onto papersheet 5 simultaneously with transport of papersheet 5 by sandwiching.

As described above, the image forming apparatus is formed of the image forming system and the paper transport system including the heating and fixing device.

Toner tank 2 includes a stirring member 21 for stirring toner 1 stored therein to frictionally charge the toner to a desired polarity and simultaneously to prevent solidification of the toner. A toner hopper 22 is further provided for replenishing toner tank 2 with toner. The toner consumed in toner tank 2 is made up for by toner hopper 22. With a constant amount of toner housed in toner tank 2, the toner is stirred by stirring member 21 to be charged to a predetermined polarity.

Doctor blade 4 provided on the side of toner tank 2 is disposed opposite to toner holder 3 at an outlet portion of toner tank 2, that is, at the exit side in the rotation direction of toner holder 3. Doctor blade 4 regulates the amount of toner (thickness of the toner layer) held on toner holder 3 to a constant amount. Doctor blade 4 is supplied with a voltage through a charge control unit 10 in order to selectively charge the toner.

By supplying the voltage to doctor blade 4, the toner held on toner holder 3 can be charged. More specifically, when the toner held on toner holder 3 is regulated by doctor blade 4, the toner is interposed between toner holder 3 and doctor blade 4. By doctor blade 4 being supplied with the voltage, the toner is charged according to the polarity of the supplied voltage. Since the toner is not only frictionally charged but also charged by the supplied voltage, the toner is charged to the frictional charge amount or more. As compared to the case where the voltage is not supplied, a larger amount of charge is obtained. By selectively supplying the voltage to doctor blade 4, the toner can be selectively charged according to a desired image. As a result, a latent image by the toner can be formed.

When the toner held on toner holder 3 and selectively charged reaches the position of opposite electrode 6, the toner is moved toward papersheet 5 transported in synchronism with movement of toner holder 3 by the action of opposite electrode 6. More specifically, since opposite electrode 6 is supplied with a voltage having the opposite polarity to that of the charged toner 1, the toner is attracted by opposite electrode 6 electrostatically to be moved toward opposite electrode 6. Therefore, the toner is transferred onto the transported papersheet. By a voltage causing movement of the toner, that is, a voltage exceeding an electric field starting movement of the toner between toner holder 3 and opposite electrode 6 being supplied, the above described selectively charged toner is transferred onto papersheet 5.

In this case, the large amount of charge of the toner increases the voltage starting movement of the toner. When the amount of charge of the toner is small, the voltage starting movement of the toner becomes small. This is because the larger amount of charge of the toner increases the attraction (image force) of the toner to toner holder 3, whereby an electric field for separating the toner from toner holder 3 to move must be larger. Therefore, opposite electrode 6 must be supplied with the larger voltage. On the contrary, if the amount of charge is small, the attraction (image force) of the toner to toner holder 3 is small, making it possible to start movement of the toner even with a small electric field.

Therefore, if the toner is selectively charged so that the amount of charge of the toner in an area corresponding to an image portion (colored area) is decreased and that the amount of charge of the toner in an area corresponding to a non-image portion is increased, only the toner of the decreased amount of charge according to the image portion is moved to be transferred onto papersheet 5, by setting the voltage supplied to opposite electrode 6 to a small voltage which is enough to move the toner of the decreased amount of charge and which is not enough to move the toner of the increased amount of charge.

Let EthL represent an electric field starting movement of the toner of the large amount of charge, and EthS represent an electric field starting movement of the toner of the small amount of charge. When only the toner of the small amount of charge is moved, a value satisfying the expressional relation of $EthS<E<EthL$ is set as an electric field E which is the voltage supplied to opposite electrode 6.

As described above, the toner selectively charged in doctor blade 4 can be transferred onto papersheet 5. By passing the transferred toner through heating and fixing device 9, image formation is completed.

Several embodiments for selectively charging toner 1 held on toner holder 3 will be described hereinafter.

(1) First Embodiment

The first embodiment for regulating the toner held on toner holder 3 by doctor blade 4 and selectively charging the toner will be described with reference to FIG. 2.

Doctor blade 4 is divided into electrodes, each of the size corresponding to one pixel, which are insulated from each other. At least a surface of doctor blade 4 opposing toner holder 3 is formed of conductive electrodes. Doctor blade 4 is disposed in parallel to a rotation axis 31 of toner holder 3, that is, orthogonally to the rotation direction of toner holder 3 with pixel information for one line simultaneously recorded. Each of divided electrodes $4_1$, $4_2$, $4_3$, . . . , $4_n$ is selectively supplied with the voltage through charge control unit 10.

Charge control unit 10 selectively supplies a constant voltage from a power source to each electrode $4_n$ through a switching element according to pixel information for one line in response to an instruction from a control circuit of the image forming apparatus, not shown. More specifically, charge control unit 10 supplies the voltage to a conductive electrode in the background corresponding to the non-image portion without supplying the voltage to conductive electrode $4_n$ corresponding to the image portion.

Under such control of voltage supply, the voltage is selectively supplied to each electrode. The toner at the electrode supplied with the voltage is charged to a higher potential than the toner at the electrode not supplied with the voltage, resulting in formation of an electrostatic latent image by the toner.

Charge control unit 10 must supply a voltage having the same polarity as that of the frictionally charged toner and higher than the charge potential of toner 1 in absolute value. Alternatively, in order to make the amount of charge of the toner corresponding to the image portion which is required to be moved later smaller than the amount of charge of the toner corresponding to the non-image portion which is not required to be moved, charge control unit 10 may supply a voltage having the opposite polarity to that of the frictionally charged toner and lower than the charged potential of toner 1 in absolute value. In this case, a voltage value which does not cause toner 1 to be changed to the opposite polarity must be set.

Toner holder 3 is formed of an elastic member such as rubber around rotation axis 31 in a roller shape. Especially in an insulated state, rotation axis 31 is supplied with a voltage for electrostatically attracting toner to the surface of toner holder 3, or rotation axis 31 is connected to ground potential. This voltage has a polarity opposite to that of the voltage supplied to each electrode of doctor blade 4 by charge control unit 10. When toner 1 is charged to a negative polarity, for example, the polarity of the voltage to be supplied to toner holder 3 is positive, and the voltage to be selectively supplied to doctor blade 4 by charge control unit 10 is negative.

Further, opposite electrode 6 for transferring the toner held on toner holder 3 and selectively charged onto papersheet 5 is supplied with a voltage of a polarity opposite to the charged polarity of the toner in order to attract the charged toner electrostatically. Consequently, the toner is attracted to be transferred onto papersheet 5 which is transported.

In this case, as a power supply voltage to be supplied to opposite electrode 6 in order to move and transfer the selectively charged toner, the toner of the small amount of charge in particular, onto the papersheet, a voltage value is set which is equal or smaller than the voltage (electric field) starting movement of the toner of the large amount of charge and which is equal or larger than the voltage (electric field) starting movement of the toner of the small amount of charge.

In the above described structure, in response to a print start signal from a host computer, not shown, such as a word processor and a personal computer, operation of the image forming apparatus is started. Stirring member 21 in toner tank 2 starts rotating to stir toner 1 therein, and feed out the toner onto toner holder 3. Simultaneously, toner 1 is charged to a specific polarity by friction. After that, toner 1 is electrostatically attracted by the surface of toner holder 3 which starts rotating, and regulated to a toner layer of a constant thickness by doctor blade 4 disposed at the outlet of toner tank 2.

The toner held on toner holder 3, whose amount is regulated by doctor blade 4, is selectively charged by electrodes $4_1$, $4_2$, $4_3$, . . . , $4_n$ of doctor blade 4 being selectively supplied with a voltage according to image information through charge control unit 10. In this case, the intensity of an electric field generated between each of electrodes $4_1$, $4_2$, $4_3$, . . . , $4_n$ and toner holder 3 in the line direction of doctor blade 4 varies depending on the applied voltage. More specifically, the intensity of the electric field is higher in the toner corresponding to electrode $4_n$ supplied with the voltage than in the toner corresponding to the other electrodes not supplied with the voltage. The amount charge of the toner corresponding to electrode $4_n$ supplied with the voltage becomes larger. Therefore, the toner in an area not supplied with the voltage is charged only to the amount of frictional charge as described above, and the toner in an area supplied with the voltage is charged to the amount of frictional charge or more.

As a result, the toner held on toner holder 3 with a constant amount is selectively charged, whereby an electrostatic latent image is formed. This image formation is carried out for every line. By selectively supplying the voltage to each electrode $4_n$ of doctor blade 4 by charge control unit 10 according to image information in synchronism with rotation of toner holder 3, a desired image, an electrostatic latent image by the toner in particular, is formed.

In order to form a visual image together with formation of the latent image by selectively moving the toner latent image and transferring the same onto papersheet 5, papersheet 5 is fed to register roller 8 in advance. Simultaneously with formation of the toner latent image on toner holder 3, register roller 8 is driven to transport papersheet 5 at a timing at which the front edge of the image matches the leading edge of papersheet 5.

The latent image by the selectively charged toner 1 is transferred onto the upper surface of transported papersheet 5 between toner holder 3 and opposite electrode 6 due to the influence of the voltage supplied to opposite electrode 6. More specifically, the selectively charged toner 1 is electrostatically attracted by an electric field generated between opposite electrode 6 behind papersheet 5 and toner holder 3, and the toner is moved from toner holder 3. Finally, the toner reaches papersheet 5, and held on the papersheet by the voltage applied to the opposite electrode therebehind.

As a power supply voltage supplied to opposite electrode 6, a voltage value is set which causes attraction and movement of the toner of the small amount of charge held on toner holder 3 and which does not cause attraction and movement of the toner of the large amount of charge.

This is because the larger amount of charge of the toner increases the attraction of the toner to toner holder 3. Therefore, the voltage to be supplied to opposite electrode 6 must be set large. When the amount of charge of the toner is small, the toner starts moving with a small voltage. Therefore, if an intermediate value between the voltage starting movement of the toner of the large amount of charge and the voltage starting movement of the toner of the small amount of charge is set as the power supply voltage, only the toner of the small amount of charge moves to be transferred onto papersheet 5.

By only the toner selectively charged by doctor blade 4 being transferred onto the papersheet as described above, the toner latent image on toner holder 3 is to be developed on papersheet 5 as a visual image. The toner image on papersheet 5 is transferred to heating and fixing device 9 to be fixed. Finally, the image is discharged outside the body of the apparatus as a desired printed material.

As described above, the toner held on toner holder 3 is selectively charged according to the image when passing through doctor blade 4. Therefore, the number of components required in the image forming system is reduced. More specifically, in doctor blade 4, the toner is selectively charged and simultaneously, the latent image by the toner is formed. As a result, the image forming apparatus can be reduced in size and cost.

In addition, not only the conductive toner but also the insulative toner can be used. This is because selective charge unnecessitates injection of electric charge, which is typical for the conventional image forming apparatus. The color toner can be used easily, and the image forming apparatus can be used as a full color printer. Therefore, using one-component insulative or conductive toner, the toner can be selectively charged to a specific polarity for image formation.

When toner 1 to be used is insulative in particular, even if the toner electrostatically attracted is moved from toner holder 3 to a papersheet not superior in conductivity, the transfer efficiency can be improved, and the toner held on the papersheet is stable after transfer.

(2) First Specific Example

In this example, toner is selectively charged, and the charged toner, especially the toner of the small amount of charge, is transferred onto papersheet 5. It is understood that the amount of toner to be moved varies depending on the amount of charge. More specifically, when the toner is moved, the amount of movement of the toner depends on the amount of charge proportionally.

Therefore, if the amount of charge of the toner can be controlled according to the image density, the amount of toner to be moved varies, generating the image density difference by the amount of toner transferred onto papersheet 5. This is half tone reproduction, enabling formation of a half tone image.

In view of the above, it is necessary to control the voltage to be supplied to doctor blade 4 according to the image density. A different voltage is supplied to each of the conductive electrodes $\mathbf{4}_1, \mathbf{4}_2, \mathbf{4}_3, \ldots, \mathbf{4}_n$ of doctor blade 4 according to the image density. If the image density is high, the voltage to be supplied is decreased in order to decrease the amount of charge of the toner. No voltage is supplied, for example. The toner is charged only by the frictional charge or less. In order to do so, the amount of charge is reduced by discharging the frictional charge of the toner or the like.

If the image density is low, a high voltage is supplied in order to increase the amount of charge of the toner. By supplying the high voltage, the amount of movement of the toner is reduced. By controlling the voltage to various values between the cases of high density and low density, the toner can be moved so that an image of the desired density can be obtained.

(b) Second Specific Example

In order to selectively charge the toner held on toner holder 3, doctor blade 4 was divided into electrodes $\mathbf{4}_1, \mathbf{4}_2, \mathbf{4}_3, \ldots, \mathbf{4}_n$ electrically insulated from each other in the above description. However, doctor blade 4 may be constituted of transparent electrodes formed on an insulative member such as a glass surface with a known method. Alternatively, the electrodes may be formed on a film with a known technology of an interconnection pattern such as printing or etching, and the film may be covered with the insulative member to be formed into doctor blade 4. In brief, a plurality of divided conductive electrodes each capable of forming one pixel may be formed on a surface of doctor blade 4 facing toner holder 3.

When electrodes $\mathbf{4}_1, \mathbf{4}_2, \mathbf{4}_3, \ldots, \mathbf{4}_n$ of doctor blade 4 are insulated from each other, there is a gap formed between pixels in the insulated portion. Therefore, a strip appears in the formed image along the rotation direction. In order to eliminate this strip, electrodes may be formed as shown in FIG. 3, for example. This doctor blade 4 is shown with a surface facing toner holder 3 enlarged.

In this doctor blade 4, each of electrodes $\mathbf{4}_1, \mathbf{4}_2, \mathbf{4}_3, \ldots, \mathbf{4}_n$ is inclined at 0° or more to toner holder 3. By the electrodes being thus provided, an area corresponding to the insulated portion between the electrodes becomes opposite to the electrodes by rotation of toner holder 3, and the portion is also charged. Therefore, a gap between dots is eliminated, and pixels may be partly overlapped according to the inclination.

(c) Third Specific Example

In the above description, since the toner passes between doctor blade 4 and toner holder 3 opposite to each other, the toner may attach to doctor blade 4 by friction or the like. This may result in variation of the amount of charge of the toner. The amount of toner varies and the amount of toner held on toner holder 3 varies, causing unstable image formation.

Figure 4:
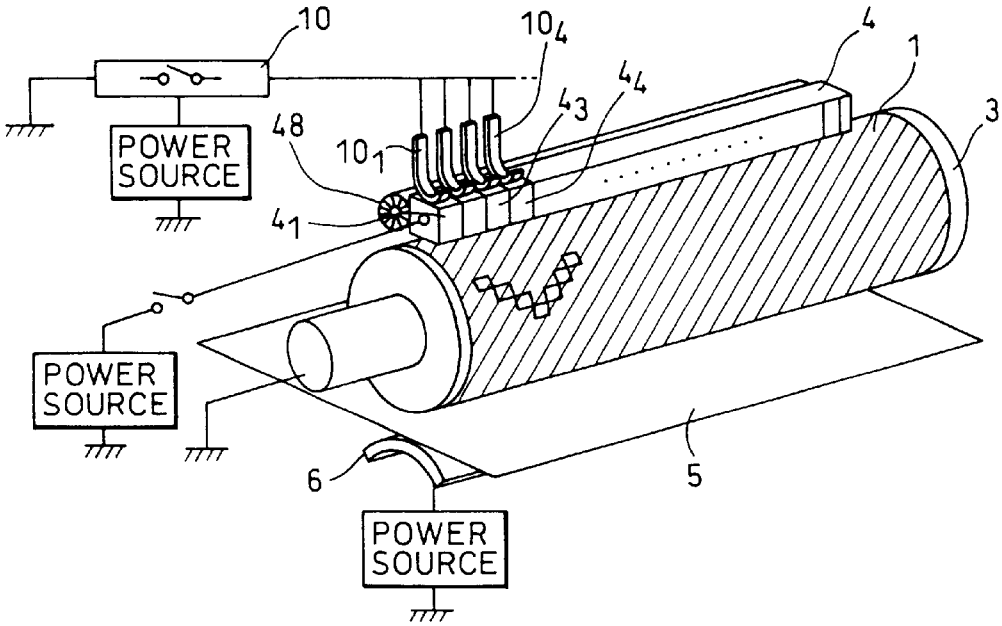
FIG. 4 is a schematic perspective view of the main part of another example of the doctor blade of the image forming apparatus according to the present invention.

In order to solve this problem, doctor blade 4 is formed into a polygonal prism having at least three surfaces as shown in FIG. 4. Conductive electrodes $\mathbf{4}_1, \mathbf{4}_2, \mathbf{4}_3, \ldots, \mathbf{4}_n$ provided on each surface are connected in common, and a voltage is selectively supplied from charge control unit 10 through terminals $\mathbf{10}_1, \mathbf{10}_2, \mathbf{10}_3, \ldots, \mathbf{10}_n$ which are in pressure contact with electrodes $\mathbf{4}_1, \mathbf{4}_2, \mathbf{4}_3, \ldots, \mathbf{4}_n$ on the surface opposite to one opposing toner holder 3.

Doctor blade 4 is rotatably provided. Doctor blade 4 is rotated for every predetermined time period so that a new electrode forming surface opposes toner holder 3. For example, doctor blade 4 of a rectangular solid is formed in FIG. 4. With the surface currently opposing toner holder 3 as the first surface, doctor blade 4 has the second, third, and fourth surfaces clockwise.

When the amount of toner held on toner holder 3 is regulated and the toner is selectively charged on the first surface, the surfaces other than the first surface are cleaned by a brush-shaped cleaning member 48. The surfaces other than the surface including terminals $\mathbf{10}_1, \mathbf{10}_2, \mathbf{10}_3, \ldots, \mathbf{10}_n$ for voltage supply come in contact with cleaning member 48. In this example, the fourth surface opposing toner tank 2 is in contact with cleaning member 48 to be cleaned.

In this structure, doctor blade 4 is rotated whenever formation of one image is completed so that the second surface, the third surface, and the fourth surface are opposite to toner holder 3 sequentially. Alternatively, doctor blade 4 is rotated according to a cycle of supply of toner from the toner hopper to toner tank 2. Further, doctor blade 4 may be rotated whenever formation of a predetermined number of images is completed. In brief, it is important to rotate doctor blade 4 to make each surface opposite to toner holder 3 sequentially so that after regulating and charging the toner, each surface is cleaned by cleaning member 48.

Therefore, it is possible to always keep the electrode surface of doctor blade 4 opposing toner holder 3 clean. This can make the amount of toner held on toner holder 3 stable, and also make the amount of charge of the toner stable.

(2) Second Embodiment

In the first embodiment, doctor blade 4 must include a plurality of electrodes $\mathbf{4}_1, \mathbf{4}_2, \mathbf{4}_3, \ldots, \mathbf{4}_n$ divided each corresponding to one pixel. Therefore, charge control unit 10 for selectively applying a voltage to each electrode has a very complicated structure, requiring a number of switching elements and also requiring a circuit selectively driving the elements. In the following embodiment, such charge control unit 10 is not required.

Figure 5:
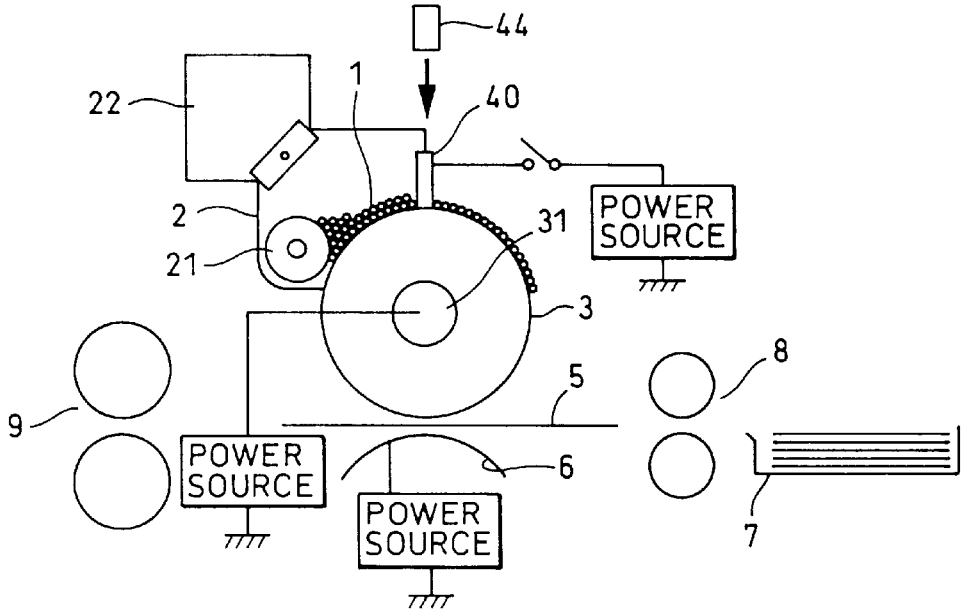
FIG. 5 is a schematic sectional view showing another embodiment of the image forming apparatus according to the present invention.
Figure 6:
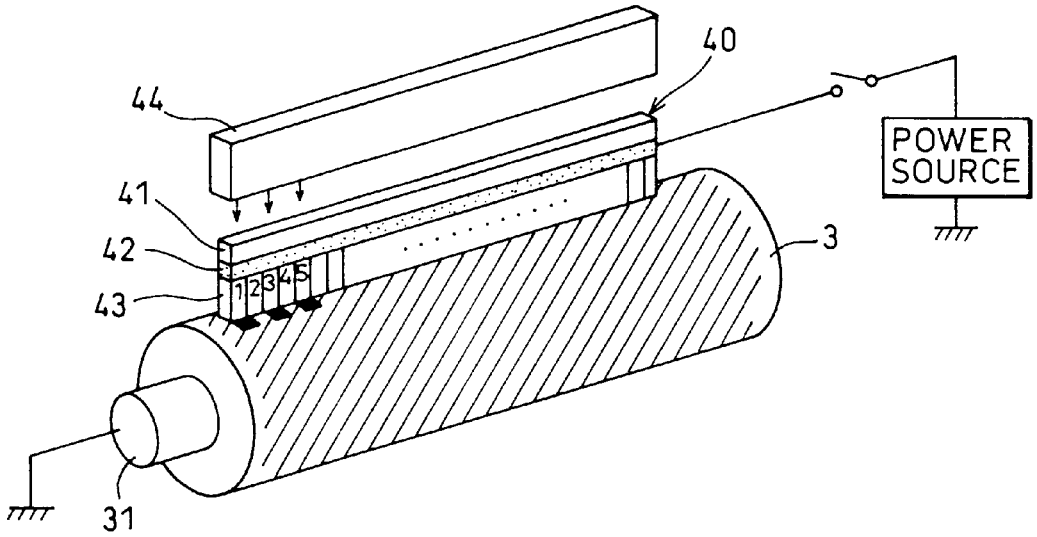
FIG. 6 is a schematic perspective view of the main part of the another embodiment shown in FIG. 5 of the image forming apparatus according to the present invention.

Referring to FIGS. 5 and 6, a doctor blade 40 according to the present embodiment includes a transparent electrode 42 formed on the one entire surface of a glass substrate 41 and a photoconductive layer 43 formed on the upper surface of transparent electrode 42. An LED array 44 for one line, for example, is provided on glass substrate 41 of doctor blade 40 in parallel with rotation axis 31 of toner holder 3.

Light from LED array 44 selectively renders photoconductive layer 43 conductive through glass substrate 41. More specifically, the resistance value of photoconductive layer 43 changes according to an area irradiated with light. Therefore, voltage supply to transparent electrode 42 causes the intensity of an electric field between photoconductive layer 43 and toner holder 3 to be different, and the toner therebetween is selectively charged according to the supplied voltage. In particular, since the area irradiated with light is rendered conductive, and the intensity of the electric field in this area becomes larger, the amount of charge of the toner in this area increases. Therefore, in LED array 44, a light emitting diode corresponding to an image portion is not driven, and a light emitting diode corresponding to a non-image portion is driven.

As described above, when a constant amount of toner is held on toner holder 3, the toner is selectively charged. A large difference in amount of charge between an area irradiated with light and an area not irradiated with light is generated, and an electrostatic latent image by the toner is formed.

A well known array is used as LED array 44, in which each LED corresponding to one pixel is selectively driven. A single light emitting diode of LED array 44 is selected for every line according to printed data from a host computer.

Instead of using LED array 44, laser light (ON or OFF controlled light signal) modulated according to image data may be directed to glass substrate 41 of doctor blade 40.

The image forming apparatus of the above described structure is the same as the apparatus of the first embodiment in that the toner held on toner holder 3 is selectively charged when regulated by doctor blade 40. The toner image can be transferred onto papersheet 5 which is sequentially transported. In this embodiment, it is not necessary to divide doctor blade 40 into a plurality of electrodes each corresponding to one pixel and to supply a voltage to each of the electrodes as shown in FIG. 2. Therefore, fabrication of doctor blade 40 is substantially simplified. Further, the photoconductive layer can be formed of the same material as a photoconductive layer of a photoreceptor used in the conventionally known electrophotography.

Further, as LED array 44, a conventionally known array can be directly used. Further, instead of LED array 44, any light irradiating member which can direct light representing an image can be used. An optical image obtained by slit exposure of an image of a copy original, not laser light, may be directed to glass substrate 41 of doctor blade 40. In this case, since it is not necessary to digitalize the image, the image of the original can directly be printed easily.

(3) Third Embodiment

Figure 7:
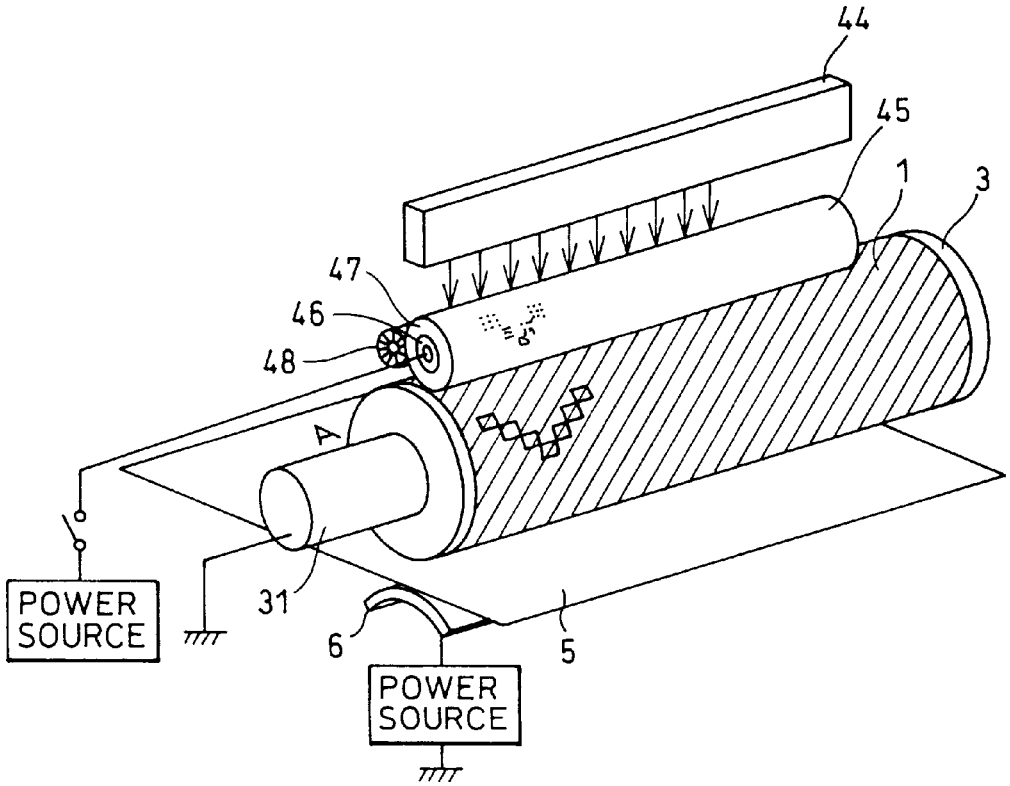
FIG. 7 is a schematic perspective view of the main part showing a further embodiment of the image forming apparatus according o the present invention.

A further improvement of the second embodiment is shown in FIG. 7.

The image forming apparatus in FIG. 7 includes doctor blade 45 which is not a rectangular solid but a cylinder as a doctor blade regulating the amount of toner held on toner holder 3. Other than that, the image forming apparatus of this embodiment is similar to those of the first and second embodiments.

Also in the image forming apparatus of the present embodiment, the amount of toner held on toner holder 3 is regulated, and simultaneously, the toner is selectively charged using photoconductivity, similarly to the case of the second embodiment.

Referring to FIG. 7, doctor blade 45 for regulating the amount of toner includes a cylindrical conductive member 46 of aluminum or the like and a photoconductive layer 47 formed on conductive member 46. Photoconductive layer 47 is rotatably supported so that it is opposite to toner holder 3, and is driven as required. The direction of rotation of doctor blade 45 is the same as that of toner holder 3.

LED array 44 for directing light representing an image is disposed opposite to doctor blade 45, as described with reference to FIG. 5. Alternatively, laser light may be directed, or an optical image from a copy original may directly be slit-exposed.

In the image forming apparatus structured as described above, light emitted from LED array 44 according to an image is first directed to rotating doctor blade 45. This causes the resistance of an area irradiated with light on the surface of doctor blade 45 to decrease, whereby a latent image due to resistance change is formed. The latent image formed by the resistance change is then opposite to doctor blade 3, so that the amount of toner held on toner holder 3 is regulated, and that the intensity of an electric field generated by a supplied voltage varies due to the difference in resistance value between an area irradiated with light and an area not irradiated with light. As a result, the toner held on toner holder 3 is selectively charged as described above, whereby a latent image by charge of the toner is formed on toner holder 3.

Also in this embodiment, charge control unit 10 is not required unlike the case of the first embodiment, thereby simplifying the structure. Further, by not only exposing a digital image but also directing a reflected optical image from the original, an image similar to the directed image can be formed easily.

Further, as shown in FIG. 7, cleaning brush 48 is provided in order to remove toner attaching to the surface of doctor blade 45. The surface of doctor blade 45 after regulating the amount of toner held on toner holder 3 and selectively charging the toner is cleaned by cleaning brush 48. Cleaning brush 48 may be provided inside toner tank 2 in order to return the toner attaching to doctor blade 45. Alternatively, cleaning brush 48 may be disposed outside toner tank 2 so that it cleans the surface of doctor blade 45 before light irradiation by LED array 44. By provision of cleaning brush 48 as described above, image formation can be carried out without any trouble.

(4) Fourth Embodiment

Figure 8:
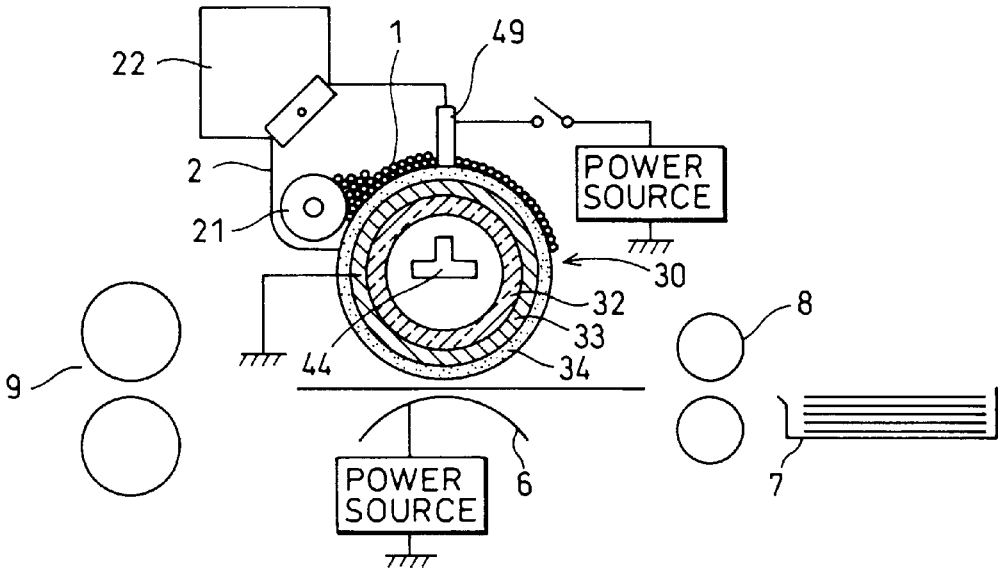
FIG. 8 is a schematic sectional view showing a further embodiment of the image forming apparatus according to the present invention.

In the above embodiment, doctor blade 40 or 45 to which an optical image is directed using LED array 44 or the like is provided opposing toner holder 3. However, a light irradiating member such as LED array 44 may be provided in toner holder 3. This embodiment is shown in FIG. 8.

The image forming apparatus according to the present embodiment is different from that of each of the above embodiments in the structure of toner holder 3. More specifically, a toner holder 30 includes a transparent conductive layer 33 formed on the surface of a transparent cylinder 32 and a photoconductive layer 34 formed on the surface of transparent conductive layer 33. Transparent conductive layer 33 of toner holder 30 is supplied with a voltage of a polarity electrostatically attracting frictionally charged toner 1. Transparent conductive layer 33 may be connected to ground potential. LED array 44 is disposed at a position opposing a doctor blade 49 with toner holder 30 therebetween in transparent cylinder 32 of toner holder 30.

Doctor blade 49 regulates the amount of toner 1 to be held on toner holder 30. Doctor blade 49 is formed of a conductive member with a voltage of a constant value for charging the toner supplied.

In the above structure, by selectively driving each LED of LED array 44, the resistance value of a driven LED is lower than that of a non-driven LED in photoconductive layer 34 of toner holder 30. Therefore, the intensity of an electric field generated in this area having the decreased resistance value, that is, an electric field between transparent conductive layer 33 and doctor blade 49 in this area is different from those of the other areas, whereby the toner is selectively charged. The selectively charged toner is transferred onto papersheet 5 which is sequentially transported at the position of opposite electrode 6.

According to this image forming apparatus, light irradiation substantially simplifies the structure of doctor blade 49. Since a light irradiating portion (LED array 44) is disposed in toner holder 30, the image forming apparatus can be more reduced in size.

Alternatively, a reflection mirror may be disposed at the position of LED array 44, so that laser light or light reflected from the original by slit exposure may be directed to the reflection mirror.

(5) First Common Specific Example for Respective Embodiments

According to each of the above embodiments, in order to transfer toner of an electrostatic latent image formed by selectively charging toner held on toner holder 3 or 30 onto papersheet 5, it is effective to form opposite electrode 6 disposed opposing toner holder 3 or 30 so as to narrow down a movement area of the toner. This is for preventing the start of movement of the toner before papersheet 5 completely reaches the movement area, which is typical in a large movement area.

Figure 9:
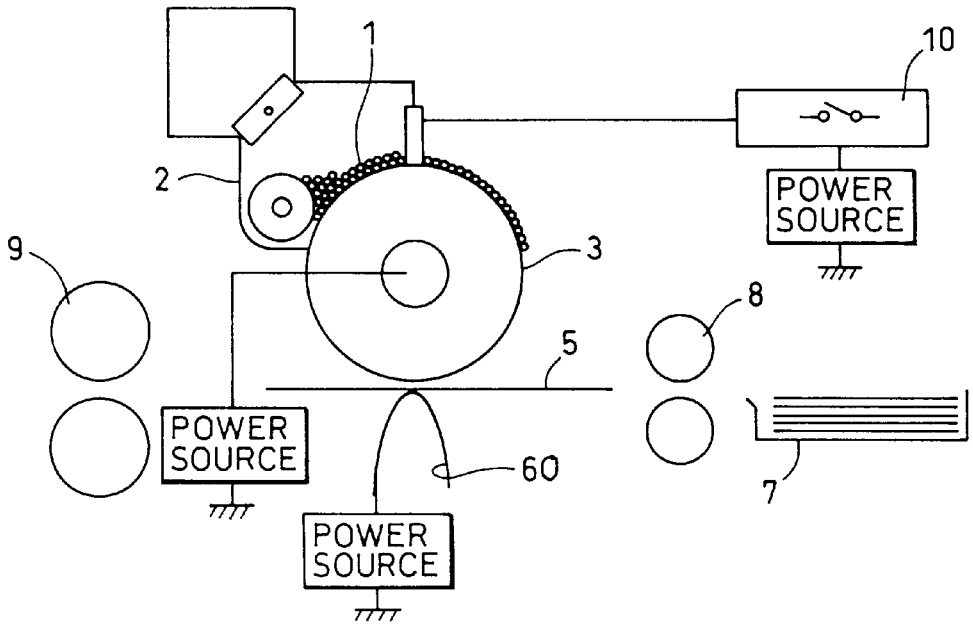
FIG. 9 is a schematic sectional view showing one specific example of an opposite electrode for transferring toner of the image forming apparatus according to the present invention.
Figure 10:
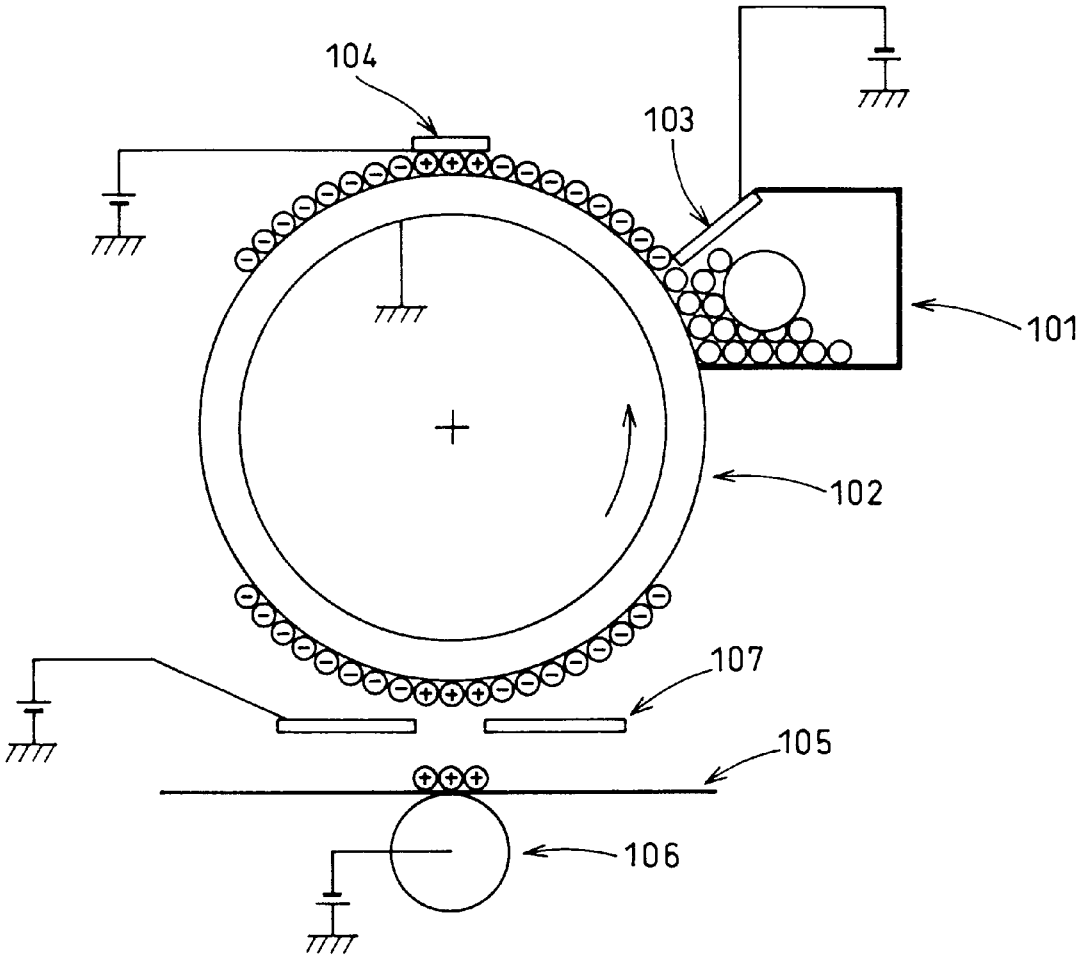
FIG.10 PRIOR ART
FIG. 10 is a sectional view showing one specific example of a conventional image forming apparatus.

In order to do so, opposite electrode 6 having as large a curvature as possible is used as shown in FIG. 9, for example. If roller-shaped opposite electrode 6 is used, one having a small diameter is essential in order to increase the curvature.

When planar opposite electrode 6 is used, and toner holder 3 is opposite to the planar opposite electrode, toner held on toner holder 3, influenced by an electric field generated, starts moving earlier. Since the width between toner holder 3 and opposite electrode 6 is constant over a longer distance, the toner starts moving before toner holder 3 and opposite electrode 6 are opposite to each other.

On the contrary, when an opposite electrode 60 having a larger curvature is used, toner holder 3 is opposite to opposite electrode 60 only over an extremely short distance. Toner starts moving in synchronism with arrival of papersheet 5. Therefore, a clear image with high resolution can be formed.

(6) Second Common Specific Example for Respective Embodiments

In each of the above embodiments, the voltage supplied to doctor blade 4 or opposite electrode 6 has a constant value. However, by controlling the supplied voltage according to environmental change, charge of toner and transfer of toner can be carried out more effectively. For more effective charge and transfer of toner, an environmental sensor 50 is arranged, and the voltage supplied to doctor blade 4 or opposite electrode 6 is controlled in response to a signal from this sensor.

The sensor 50 detecting the environmental change is disposed at an appropriate position of the image forming apparatus, such as around the image forming system as shown in FIG. 1. The sensor includes a humidity sensor and a temperature sensor, for example. In response to outputs from these detecting sensors, a value of the voltage supplied between doctor blade 4 and toner holder 3 is controlled. When an electric field applied at a low temperature and a low humidity is $E_L$, an electric field applied at a normal temperature and a normal humidity is $E_N$, and an electric field applied at a high temperature and a high humidity is $E_H$, the voltage supplied to doctor blade 4, in particular, is controlled so as to satisfy the relational expression of $E_H \leqq E_N \leqq E_L$.

At a high temperature and a high humidity, for example, the amount of charge of toner tends to be decreased. In order to make the amount of charge constant, it is effective to increase the voltage supplied to doctor blade 4. By controlling the voltage according to the above relational expression, it is possible to make the amount of charge of toner always constant.

On the other hand, by making the amount of charge of toner constant as described above, the selectively charged toner can be moved toward opposite electrode 6 supplied with a constant voltage. However, taking into consideration the case where the amount of charge cannot be constant, controlling the voltage supplied to opposite electrode 6 can also be an effective means.

The voltage supplied to opposite electrode 6 is controlled based on the outputs of both the humidity sensor and the temperature sensor 50. As compared to the amount of charge of toner at a normal temperature and a normal humidity (qN), the amount of charge of toner at a low temperature and a low humidity (qL) tends to be higher, and the amount of charge of toner at a high temperature and a high humidity (qH) tends to be lower. Therefore, the relationship among the amounts of charge of toner is $qH \leqq qN \leqq qL$ due to the environmental change.

Since the decreased amount of charge of toner causes the attraction of the toner onto toner holder 3 to weaken, if the voltage supplied to opposite electrode 6 is constant, a larger amount of toner naturally moves. This results in movement of not only selectively charged toner but also non-charged toner. Therefore, if the amount of charge is decreased, the voltage supplied to opposite electrode 6 is optimally controlled to be low.

Therefore, an electric field (E) generated by the voltage supplied between toner holder 3 and opposite electrode 6 is controlled so that the relational expression of $Eh \leqq En \leqq E1$ is satisfied, wherein Eh is an electric field at a high temperature and humidity, En is an electric field at a normal temperature and humidity, and E1 is an electric field at a low temperature and humidity. Therefore, control is carried out so that a lower voltage is supplied to opposite electrode 6 at a high temperature and humidity than at a normal temperature and humidity, and that a higher voltage is supplied to opposite electrode 6 at a low temperature and humidity than at a normal temperature and humidity. This results in control of the voltage supplied to opposite electrode 6 to be lower in absolute value according to the environmental change causing the amount of charge of toner to decrease. Therefore, only the selectively charged toner can be transferred onto papersheet 5 efficiently, enabling formation of a clear image.

(7) Third Common Specific Example for Respective Embodiments

In the above description, an image is formed in equal-scale magnification. More specifically, the circumference speed of toner holder 3 is identical to the transport speed of papersheet 5, and an image on toner holder 3 in the line direction is formed in equal-scale magnification.

In order to change the magnification of an image to be formed, a conductive electrode is selected or drive of each light emitting diode of the LED array is controlled so that a portion corresponding to the image is enlarged/reduced according to a variable-scale magnification in the line direction (the direction orthogonal to the transport direction of the papersheet). On the other hand, in order to change the magnification in the transport direction of the papersheet, the circumference speed of toner holder 3 is made constant, and the transport speed of the papersheet is changed according to the variable-scale magnification. More specifically, when the image is reduced, the transport speed is decreased, and when the image is enlarged, the transport speed is increased. This results in reduction of the image in the transport direction of the papersheet, whereby a desired image can be obtained.

When resistance change of the photoconductive layer is used in the second, third, and fourth embodiments in order to selectively charge toner to toner holder 3, an optical image reflected from the original may just be directed according to the variable-scale magnification.

When the magnification is changed in the transport direction of the papersheet, a timing at which the voltage is supplied to doctor blade 4 is controlled, whereby a dot shape of the image in the rotation direction can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus holding toner on a toner holder and forming an image according to externally applied image data, comprising:

a toner tank for storing and supplying toner;

a toner holder holding an amount of toner supplied from said toner tank;

a doctor blade for regulating the amount of toner held on said toner holder and selectively charging said toner according to said externally applied image data, said doctor blade being connected to a voltage supplying means for supplying a voltage for selectively charging said toner to a specific polarity according to said image data;

wherein said doctor blade is divided into conductive electrodes corresponding to pixels constituting said image data and being insulated from each other, where said voltage supplying means selectively supplies a voltage to said divided conductive electrodes according to said image data;

an opposite electrode provided opposing said toner holder with a sheet in-between and connected to a power source for transferring said selectively charged toner onto a sheet; and wherein said doctor blade has said conductive electrodes corresponding to said pixels inclined to a rotation direction of said toner holder.

2. The image forming apparatus according to claim 1, further comprising:

a sensor for detecting environmental change around said image forming apparatus; and means responsive to a detect signal of said sensor for controlling a voltage supplied between said doctor blade and said toner holder.

3. The image forming apparatus according to claim 1, further comprising:

a sensor for detecting environmental change around said image forming apparatus; and control means responsive to a detect signal of said sensor for controlling a voltage for transferring said selectively charged toner onto a recording sheet.

4. An image forming apparatus holding toner on a toner holder uniformly, and after selectively charging said held toner according to image data, transferring said selectively charged toner onto a sheet to form an image, comprising:

a toner tank storing said toner;

a cylindrical toner holder holding the toner in said toner tank and rotated;

a doctor blade for regulating the amount of toner held on said toner holder and selectively charging said toner, said doctor blade including a transparent conductive layer and a photoconductive layer formed thereon, said photoconductive layer being opposite to said toner holder;

means for supplying to said transparent conductive layer a voltage for charging the toner on said toner holder to a specific polarity; and means for directing light representing the image data to a side of said transparent conductive layer, whereby the toner held on said toner holder is selectively charged.

5. An image forming apparatus holding toner on a toner holder uniformly, and after selectively charging said held toner according to image data, transferring said selectively charged toner onto a sheet to form an image, comprising:

a toner tank storing said toner;

a cylindrical toner holder holding said toner and rotated;

a doctor blade for regulating the amount of toner held on said toner holder and selectively charging said toner, said doctor blade including a photoconductive layer formed on a cylindrical conductive member and being rotated in the same direction as a rotation direction of said toner holder;

a charger for supplying to said conductive member a voltage for charging said toner to a specific polarity; and means for directing light representing the image data to a side of said photoconductive layer, whereby the toner held on said toner holder is selectively charged.

* * * * *